US005802765A

United States Patent [19]

Vickery

[11] Patent Number: 5,802,765

[45] Date of Patent: Sep. 8, 1998

[54] DOOR ASSEMBLY AND SECURITY GUARD

[75] Inventor: Raymond Sydney Vickery, Queensland, Australia

[73] Assignee: Grace Bernadette Dean, Queensland, Australia

[21] Appl. No.: 737,169

[22] PCT Filed: Aug. 18, 1995

[86] PCT No.: PCT/AU95/00512

§ 371 Date: Nov. 5, 1996

§ 102(e) Date: Nov. 5, 1996

[87] PCT Pub. No.: WO96/06254

PCT Pub. Date: Feb. 29, 1996

[30] Foreign Application Priority Data

Aug. 18, 1994 [AU] Australia ..... PM 7530
Apr. 7, 1995 [AU] Australia ..... PN 2221

[51] Int. Cl.[6] ..... E05B 65/04

[52] U.S. Cl. ..... 49/67; 49/460

[58] Field of Search ..... 49/460, 61, 63, 49/67; 70/416, 417, 418; 292/346

[56] References Cited

U.S. PATENT DOCUMENTS 4,452,011 6/1984 Trombettas ..... 49/63 X
4,993,187 2/1991 Schweiss et al. ..... 49/67 X
5,076,626 12/1991 Tiddy et al. ..... 49/460 X
5,400,628 3/1995 Ryan ..... 70/417
5,586,796 12/1996 Fraser ..... 70/416 X

*Primary Examiner*—Jerry Redman
*Attorney, Agent, or Firm*—Young & Thompson

[57] ABSTRACT

A screen door assembly for use with a generally rectangular door jamb includes a hinged door comprising a peripheral frame having vertical frame members and horizontal frame members. The frame member is hinged so that the door can swing within the door jamb. The vertical member includes a handle and a lock assembly so that the door can be locked from the inside. The door assembly can be used for persons to enter and exit a structure. The structure can be a room, a building or it can be a main access door. The door assembly may be used independently, but most typically, the door assembly is employed as a security door in conjunction with a second door. In the illustrated embodiment, a security screen infills between the frame members, and a frame member employs a generally planar guard protruding and covering a portion of the screen adjacent the lock assembly. The guard inhibits access from the outside through the screen to the lock.

12 Claims, 5 Drawing Sheets

DOOR ASSEMBLY AND SECURITY GUARD

BACKGROUND OF THE INVENTION

1. Field of the Invention

THIS INVENTION relates to a door assembly and in particular but not limited to a door assembly for homes to provide improved security.

2. Description of the Related Art

Nowadays, many homes employ main entrances, having outer and inner doors. One of the doors is usually screened to allow ventilation while the other door is open. This door has become known as a security door and can be hinged or sliding. This door usually employs some kind of lock or latch adjacent a handle so the door can be latched and held closed from the inside. A major security problem arises with these doors because an intruder can gain access to the inside latch, or where keys are involved, the home owner frequently leaves the keys inside and it is possible for an intruder to pass his hand or a tool through the screen and release the lock and thereby gain entry.

SUMMARY OF THE INVENTION

It is an object of the present invention to alleviate, at least to some degree, the aforementioned problems associated with the prior art.

In one aspect therefore, the present invention resides in a screen door assembly allowing authorized passage of persons from outside to inside a structure, the door assembly comprising a generally rectangular door jamb, a generally rectangular peripheral door frame supported in the door jamb, the frame having vertical side members, a screen infill coupled to the frame and extending between the vertical side members and allowing ventilation through the door, one vertical side member having a lock assembly adapted to secure the door in a locked position, the lock assembly having, on an inside thereof, manually operable release means characterised in that, there is provided a generally planar guard covering a portion of said screen adjacent said lock assembly to inhibit outside unauthorized access to the said release means when the door is locked.

The guard can be permanently secured, for example, by welding to the vertical frame member or can be detachably secured, for example, by fasteners to the vertical frame member. In the latter case, the guard is preferably, generally U-shaped having projecting legs that are fastened to the frame member on opposite sides of the lock assembly. Where the lock assembly includes a door handle overhanging the screen, the guard is preferably dimensioned and arranged so that when an outside force is applied to the guard, the guard flexes against the door handle.

As most lock assemblies include a protruding body portion protruding from the vertical frame member, the guard is preferably formed with a recess adapted to surround a major portion of the protruding body portion. The guard is preferably adapted to fit around different sized body portions of different lock assemblies, the guard typically being provided with frangible or breakout sections so that the recess can be selectively enlarged to fit different body portions.

In a preferred form the present invention resides in a security guard for an elongate door lock having a door handle, the guard comprising a sheet of material having an elongate aperture adjacent an edge thereof so that the sheet of material can be sandwiched between the elongate door lock and an associated door and be held in place by the door lock.

The lock assembly is typically generally narrow and rectangular and protrudes from the vertical frame member, the guard being detachably secured to the vertical frame member and comprises a plate having a recess extending along and accommodating the lock assembly, the plate projecting from the lock assembly along a major portion of the length of the lock assembly.

The lock assembly typically includes a body removable portion and the guard is sandwiched between the removable body portion and the frame member along a marginal edge portion of the guard.

The lock assembly typically includes a generally rectangular body portion having an outer perimeter and the guard includes a rectangular aperture disposed within the perimeter of the body portion.

The guard is preferably about 200 mm long by about 100 mm wide having an aperture located adjacent an edge of the guard through which operative parts of the lock assembly pass.

The lock assembly in one form includes a handle projecting a defined distance transversely of the longitudinal axis of the vertical frame member and generally parallel to the screen infill, the guard projecting marginally beyond and generally parallel to the handle.

Where the guard employs an aperture, the aperture is about 140 mm long by about 20 mm wide and 5 mm to 10 mm from the edge of the guard.

In another embodiment the aperture is 120 mm to 140 mm long and 15 mm to 25 mm wide.

BRIEF DESCRIPTION OF THE DRAWINGS

In order that the present invention can be more readily understood and be put into practical effect, reference will now be made to the accompanying drawings and wherein.

METHOD OF PERFORMANCE

Figure 1:
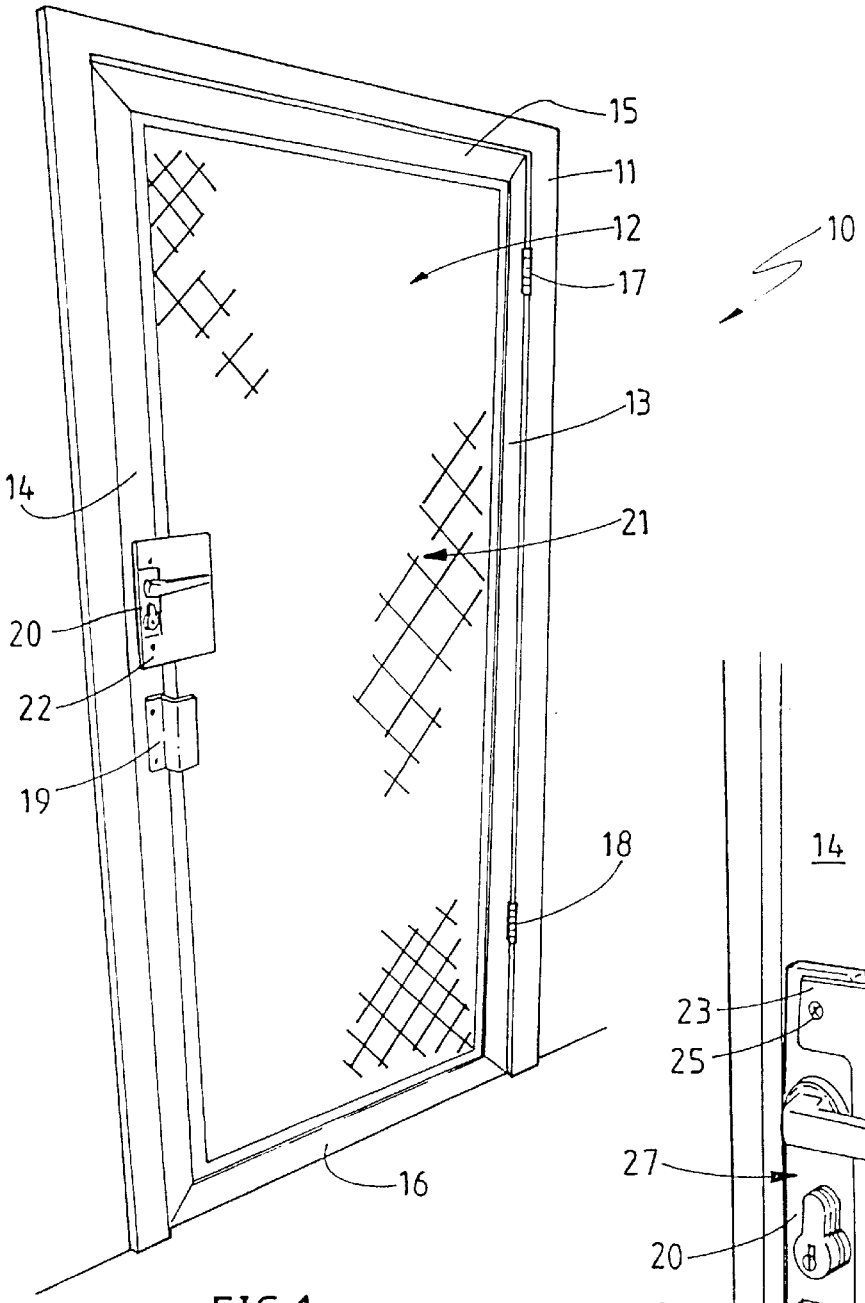
FIG. 1 is a schematic, perspective view of a door assembly according to the present invention.

Referring to the drawings and initially to FIG. 1, there is illustrated a door assembly 10 which in this case involves a generally rectangular door jamb 11, a hinged door 12 comprising a peripheral frame having vertical frame members 13 and 14 and horizontal frame members 15 and 16, the frame member 13 being hinged at 17 and 18 so that the door can swing within the door jam 11. The vertical member 14 includes a handle 19 and a lock assembly 20 so that the door can be locked from the inside. FIG. 1 is an inside view of the door assembly. The door assembly can be used for persons to enter and exit a structure. The structure can be a room, a building or it can be a main access door. The door assembly of FIG. 1 illustrates a single door, but most typically, the door assembly is employed as a security door in conjunction with a second door. In the illustrated embodiment, a security screen 21 infills between the frame members 13,14,15 and 16 and the frame member 14 employs a generally planar guard 22 protruding and covering a portion of the screen 21 adjacent the lock assembly 20. The guard 21 inhibits access from the outside through the screen 21 to the lock 20.

The guard 22 is secured on the inside of the door.

Figure 2:
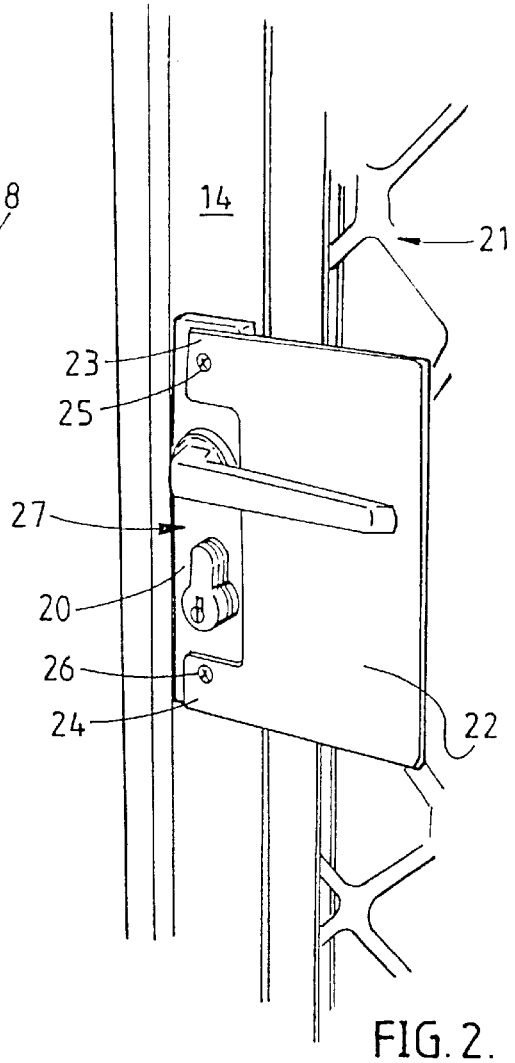
FIG. 2 is a close-up view of a portion of the door assembly of FIG. 1.

This can be more easily seen in FIG. 2 and where appropriate, like numerals have been used to illustrate like features. As can be seen in the embodiment of FIG. 2, the guard 22 is generally a U-shaped plate having legs 23 and 24 and has been held in place by screw fasteners 25 and 26, the guard includes a recess 27 housing the lock assembly 20.

Figure 3:
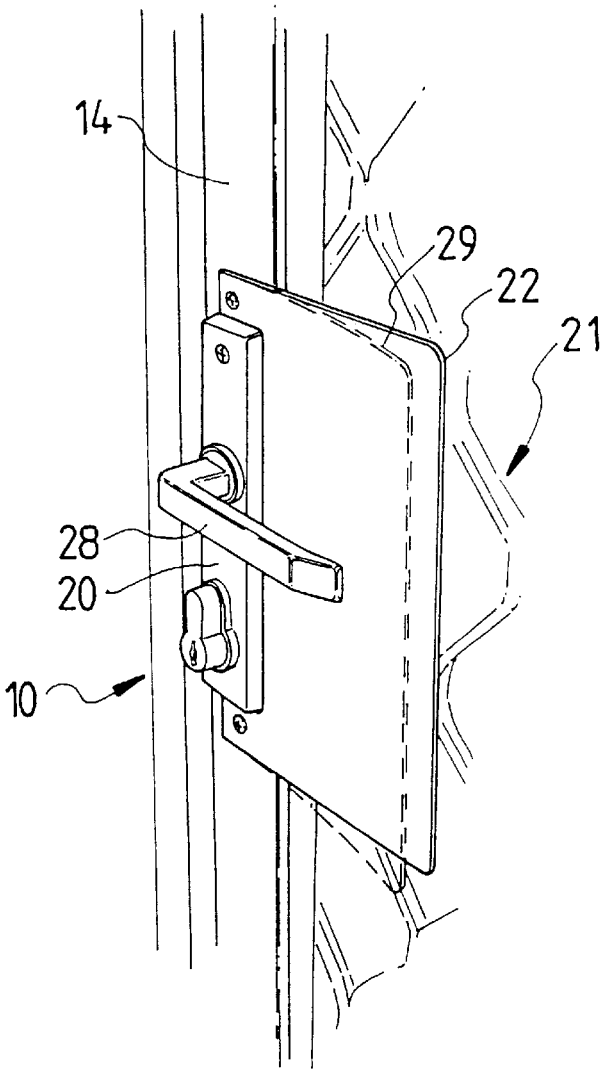
FIG. 3 is a perspective view illustrating operation of a guard suitable for a door assembly according to the present invention.

Operation of the guard 22 is illustrated in FIG. 3 and as can be seen, the lock assembly in this case employs a handle 28 which overhangs a portion of the screen 21 and in this case, the guard 22 is made from a flexible or semi-rigid material such as polycarbonate sheeting so that if an intruder attempts to break or otherwise damage the guard 22, it is capable of flexing to the position illustrated in phantom at 29. It will be appreciated that the guard, in this case, is capable of flexing up against the handle 28 in order to further resist the action of the intruder.

As lock assemblies, such as the lock assembly 20, can vary in length and depth. The guard, according to the present invention, can include size adjustment to cater for this.

Figure 4:
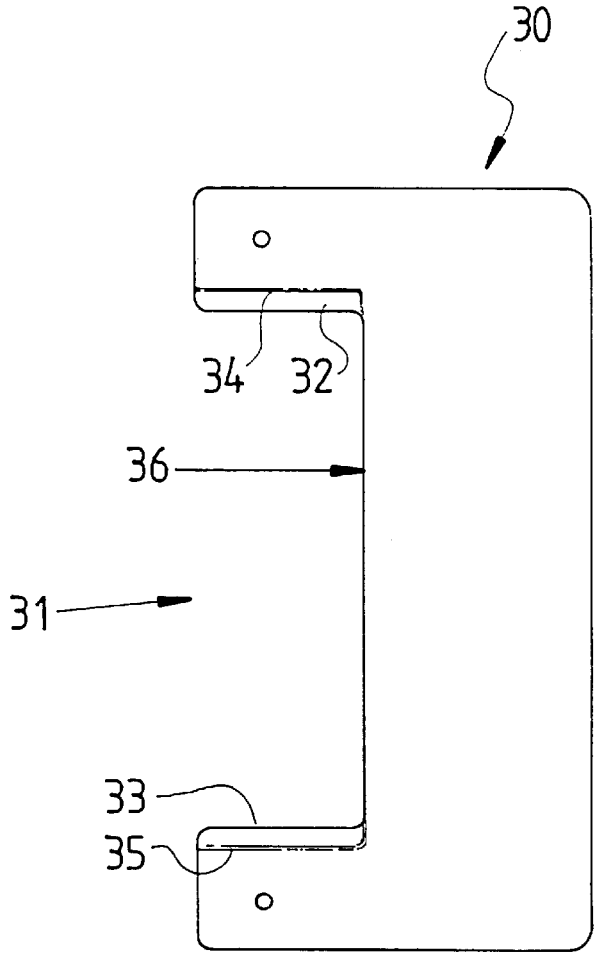
FIG. 4 is a side view of another embodiment of a guard suitable for a door assembly according to the present invention.

FIG. 4 illustrates a further embodiment of the present invention, where a guard 30 is generally the same configuration as the guard 22 is illustrated, but in this case, it employs a recess 31 having edges 32 and 33 set to a normal minimum size for the length of typical lock assembly 20. The edges 32 and 33 have a marginal portion defined by a line of weakness, in this case, at 34 and 35 so that the edge can be broken away for the larger and longer lock assemblies commonly employed. Further lines of weakness can be employed in situations where there are longer or wider lock assemblies. Edge 36 of the recess 31 can include flangable sections as required and indeed as necessary the guard 30 according to the present invention can be arranged to cater for various lock assemblies that are commonly available on the market.

Figure 5:
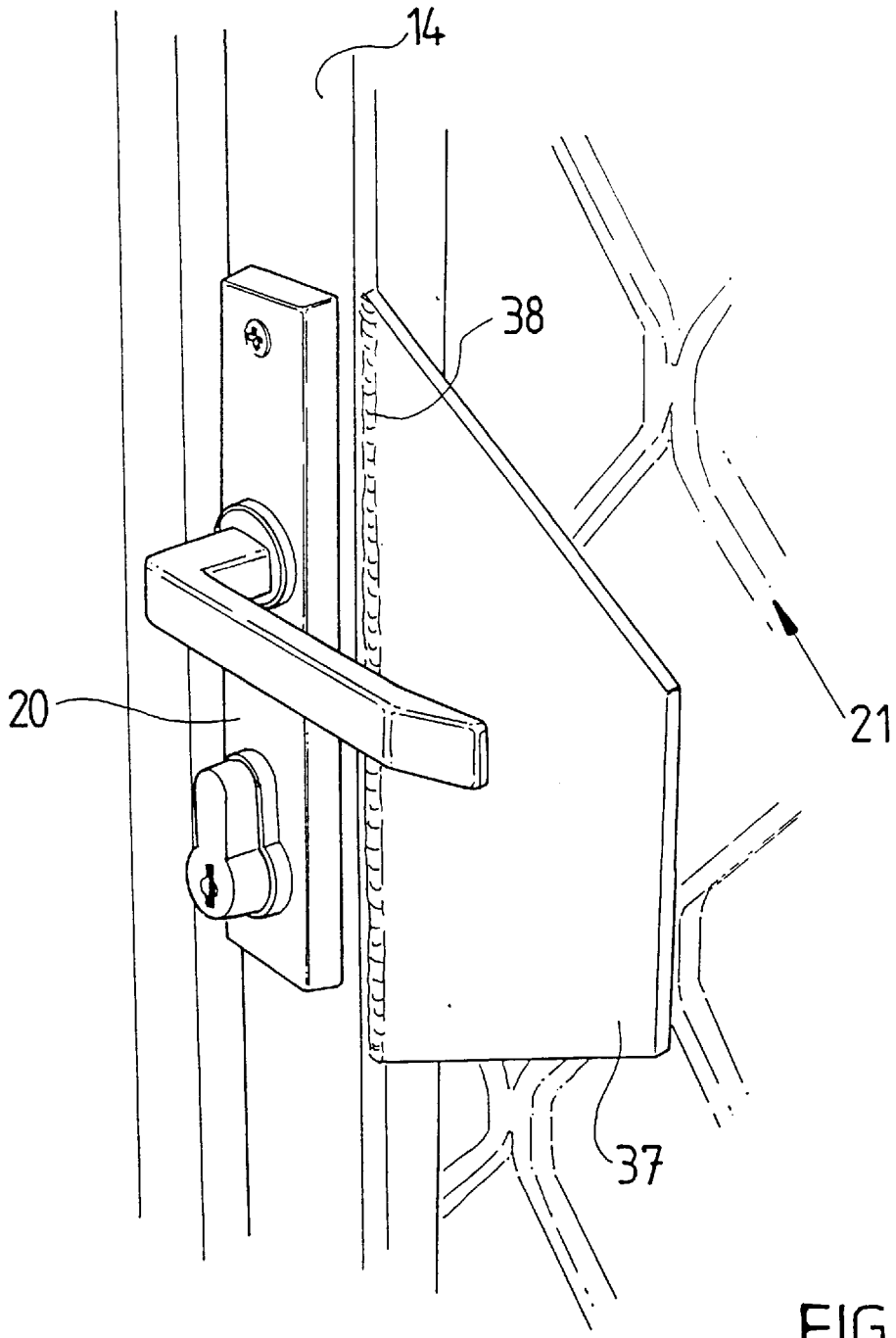
FIG. 5 is an alternative embodiment of the present invention.

Referring now to FIG. 5, there is illustrated an alternative embodiment and where appropriate, like numerals have been used to illustrate like features. In this case, the invention involves the use of a guard 37 which is welded or otherwise secured at 38 to the frame member 14, but in this case is not adapted to surround in releaseable fashion the lock assembly 20. It will however be appreciated that, in this case, the guard 37 can be made when the door is originally built, whereas in the embodiments previously described, the guard is welded to the door as a retro fit.

Figure 6:
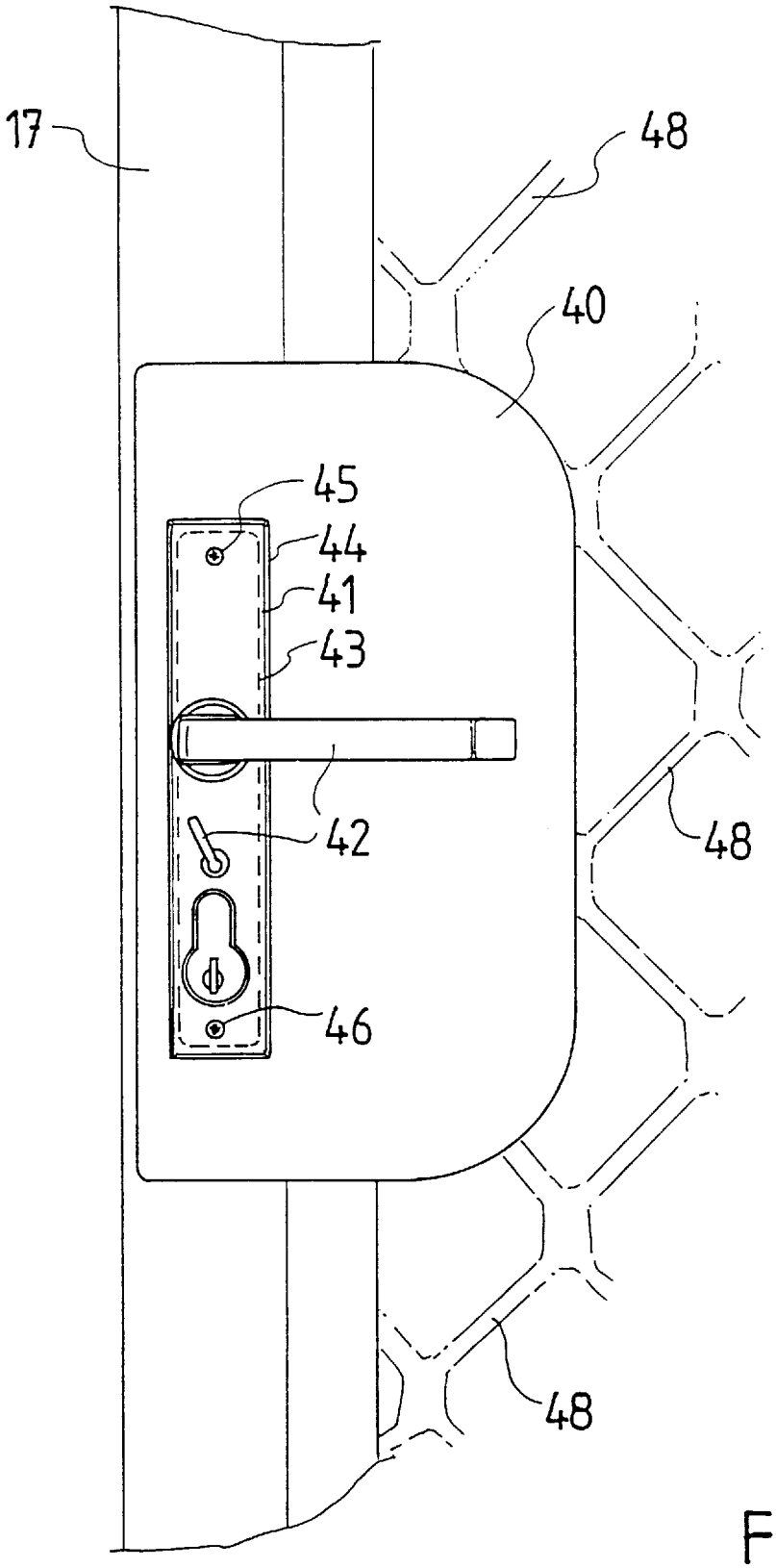
FIG. 6 is a front view of a door lock employing a guard according to a further embodiment of the invention.
Figure 7:
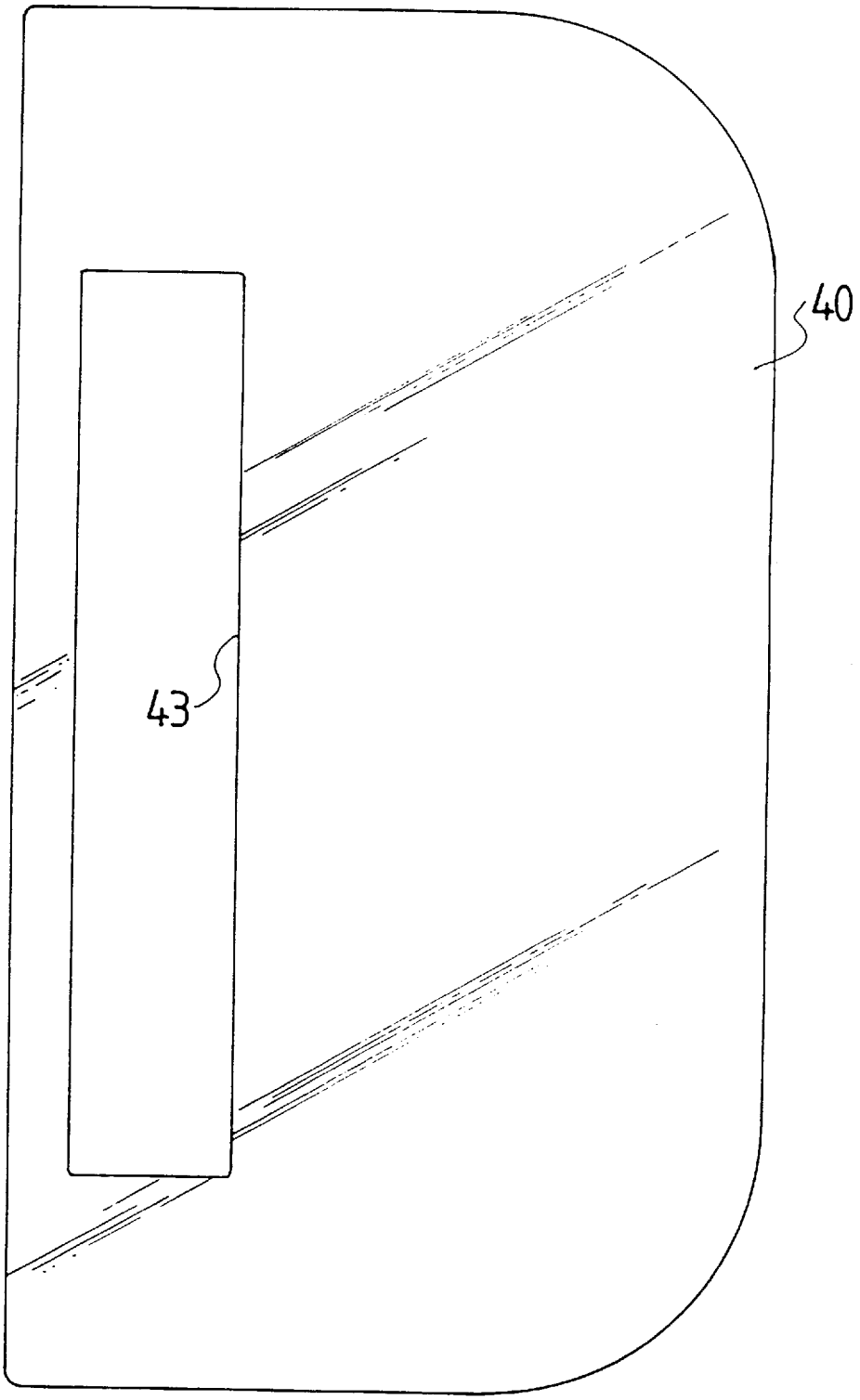
FIG. 7 is a side view of the guard of FIG. 6 prior to being secured in place.

Referring to the FIGS. 6 and 7 there is illustrated a guard 40 similar to the previous embodiments but with added advantages, the guard is for use as part of a door assembly allowing authorized passage of persons from outside into a structure, the door assembly comprising a generally rectangular door jamb, a generally rectangular peripheral door frame supported in the door jamb, the frame having vertical side members, a screen infill coupled to the frame and extending between the vertical side members and allowing ventilation through the door, one vertical side member having a lock assembly adapted to secure the door in a locked position, the lock assembly having, on an inside thereof, manually operable release means characterised in that, there is provided a generally planar guard 40 having a portion set adjacent said screen and said lock assembly 41 to inhibit outside unauthorized access to the said release means when the door is locked, the release means being shown generally at 42, the guard having an aperture defined by perimeter 43 (marked in phantom in FIG. 6) slightly smaller than the lock body 44 there being provided screws 45 and 46 which hold the lock body 44 in place and these are in turn used to secure and sandwich the guard 40 between the lock body and the door frame 47.

The dimensions of the guard shown in the drawing are 220 mm long by 120 mm wide, the aperture being 19 mm wide and 137 mm long and being positioned 6 mm from the nearest edge of the guard, the objective of this embodiment being to form the aperture so that the operative parts of the lock can pass through but the aperture remain concealed. The aperture need not be a single aperture for these purposes but could be multiple apertures. The screen infill materials are shown generally at 48.

FIG. 5, 6 and 7 serve to illustrate alternative variations of the present invention and it will therefore be appreciated that whilst the above has been given by way of illustrative example of the present invention, many variations and modifications thereto will be apparent to those skilled in the art without departing from the broad ambit and scope of the invention as set forth in the appended claims.

I claim:

1. A screen door assembly for a building comprising a generally rectangular door jamb, a generally rectangular, peripheral door frame supported in the door jamb, the frame having vertical side members, the frame supporting a screen infill, one vertical side member having a relatively small centrally positioned lock assembly with an exposed manually operable release means, wherein there is provided a generally planar guard marginally larger than the lock assembly covering a portion of said screen adjacent said lock assembly to inhibit outside unauthorized access to said release means through said screen infill when the screen door is locked;

wherein the lock assembly includes a handle projecting a defined distance transversely of the longitudinal axis of the vertical frame member and generally parallel to the screen infill, the guard protecting marginally beyond and generally parallel to the handle; and wherein the guard is made from a semi-rigid material, the guard being capable of flexing toward the handle if a force is applied against the guard from an exterior side of the door assembly.

2. A screen door assembly according to claim 1 wherein the lock assembly includes a removable body portion and the guard is sandwiched between the removable body portion and the side member along a marginal edge portion of the guard.

3. A screen door assembly according to claim 1 wherein the lock assembly includes a generally rectangular body portion having an outer perimeter and the guard includes a rectangular apenture disposed within the perimeter of the body portion.

4. A screen door assembly according to claim 1 wherein the guard is about 200 mm long by about 100 mm wide having an aperture located adjacent an edge of the guard through which operative parts of the lock assembly pass.

5. The screen door assembly of claim 1, wherein the guard is disposed between the handle and the screen.

6. A screen door assembly for a building comprising a generally rectangular door jamb, a generally rectangular, peripheral door frame supported in the door jamb, the frame having vertical side members, the frame supporting a screen infill, one vertical side member having a relatively small centrally positioned lock assembly with an exposed manually operable release means, wherein there is provided a generally planar guard marginally larger than the lock assembly covering a portion of said screen adjacent said lock assembly to inhibit outside unauthorized access to said release means through said screen infill when the screen door is locked;

wherein the lock assembly is generally narrow and rectangular and protrudes from the vertical side member, the guard being detachably secured to the vertical side member and comprises a plate having a recess extending along and accommodating the lock assembly, the plate projecting from the lock assembly along a major portion of a length of the lock assembly; and wherein the recess is bounded by at least one frangible portion, the at least one frangible portion being removable to accommodate a plurality of dimensions of the lock assembly.

7. A screen door assembly for a building comprising a generally rectangular door jamb, a generally rectangular, peripheral door frame supported in the door jamb, the frame having vertical side members, the frame supporting a screen infill, one vertical side member having a relatively small centrally positioned lock assembly with an exposed manually operable release means, wherein there is provided a generally planar guard marginally larger than the lock assembly covering a portion of said screen adjacent said lock assembly to inhibit outside unauthorized access to said release means through said screen infill when the screen door is locked;

wherein the guard may be removed without removing any other portion of the door assembly.

8. A screen door assembly for a building comprising a generally rectangular door jamb, a generally rectangular, peripheral door frame supported in the door jamb, the frame having vertical side members, the frame supporting a screen infill, one vertical side member having a relatively small centrally positioned lock assembly with an exposed manually operable release means, wherein there is provided a generally planar guard marginally larger than the lock assembly covering a portion of said screen adjacent said lock assembly to inhibit outside unauthorized access to said release means through said screen infill when the screen door is locked;

wherein the lock assembly is generally narrow and rectangular and protrudes from the vertical side member, the guard being detachably secured to the vertical side member and comprises a plate having a recess extending along and accommodating the lock assembly, the plate protecting from the lock assembly along a major portion of a length of the lock assembly; and wherein the guard may be removed without removing any other portion of the door assembly.

9. A screen door assembly according to claim 8 wherein the lock assembly includes a removable body portion and the guard is sandwiched between the removable body portion and the vertical frame member along a marginal edge portion of the guard.

10. A screen door assembly according to claim 8 wherein the lock assembly includes a generally rectangular body portion having an outer perimeter and the guard includes a rectangular aperture disposed within the perimeter of the body portion.

11. A screen door assembly according to claim 8 wherein the guard is about 200 mm long by about 100 mm wide having an aperture located adjacent an edge of the guard through which operative parts of the lock assembly pass.

12. A screen door assembly according to claim 8 wherein the lock assembly includes a handle projecting a defined distance transversely of the longitudinal axis of the vertical frame member and generally parallel to the screen infill, the guard projecting marginally beyond and generally parallel to the handle.

* * * * *